US006047965A

United States Patent [19]

Mollo et al.

[11] Patent Number: 6,047,965

[45] Date of Patent: Apr. 11, 2000

[54] RANDOMIZED ROULETTE WHEEL

[76] Inventors: Paul Thomas Mollo, 37 Heald Cir., Brigantine, N.J. 08203; Peter Joseph Ortiz, 1436 W. Riverside Dr., Atlantic City, N.J. 08401

[21] Appl. No.: 09/176,152

[22] Filed: Oct. 21, 1998

[51] Int. Cl.[7] ..... A63F 5/04

[52] U.S. Cl. ..... 273/142 E; 273/142 R; 273/142 D

[58] Field of Search ..... 273/142 D, 142 E, 273/142 F, 142 G, 142 H, 142 HA, 142 J, 142 JA, 142 JB, 142 JC, 142 JD, 142 R; 446/179

[56] References Cited

U.S. PATENT DOCUMENTS

| | | | |
|---|---|---|---|
| 2,138,532 | 11/1938 | Wobensmith | 273/142 R |
| 3,063,720 | 11/1962 | Unglesby | 273/145 C |
| 3,184,238 | 5/1965 | Steudkowski | 273/142 R |
| 3,877,700 | 4/1975 | Moe | 273/119 R |
| 4,185,828 | 1/1980 | Fernandez | 273/142 J |
| 4,337,945 | 7/1982 | Levy | 273/142 E |
| 4,601,470 | 7/1986 | Kadota | 273/142 E |
| 4,869,505 | 9/1989 | Manabe | 273/142 R |
| 4,906,005 | 3/1990 | Manabe | 273/142 R |
| 4,989,873 | 2/1991 | Manabe | 273/142 R |

FOREIGN PATENT DOCUMENTS

| | | | |
|---|---|---|---|
| 760845 | 3/1934 | France . | |
| 2204648 | 8/1973 | Germany . | |
| 2053008 | 2/1981 | United Kingdom | 446/179 |

*Primary Examiner*—Benjamin H. Layno
*Attorney, Agent, or Firm*—Rothwell, Figg, Ernst & Kurz

[57] ABSTRACT

In a roulette wheel assembly, canoes, which equiangularly spaced around a circle intermediate a wheel and an upper track where travel of a roulette ball begins, are modified. Air outlets are provided in each canoe. Air from a source is controlled to provide randomized outputs of air from each canoe in order to affect the travel of a ball in a vicinity of a canoe in order to increase randomization of travel of the ball.

14 Claims, 5 Drawing Sheets

RANDOMIZED ROULETTE WHEEL

BACKGROUND OF THE INVENTION

1. Field of the Invention

The present invention relates to gaming devices, and more specifically to an apparatus for randomizing the travel of a roulette ball.

2. Description of Related Art

Roulette is an extremely popular casino game in Europe, the United States and around the world. The game dates back nearly two centuries. A wheel is mounted in an assembly called a bowl. The wheel is rotatably mounted on a main spindle at the center of the bowl. The bowl comprises a circular ball track near its outer diameter in which the ball revolves around the spindle and a lower track which slopes from the ball track downwardly to the outer diameter of the wheel. In an outer annular band of the wheel is a band containing equiangularly spaced outward facing numbers. In registration with each number is a ball pocket. Each ball pocket preferably includes a pocket pad to damp motion of a ball, and the ball pockets are separated by radially disposed separators. Within the lower track are eight equiangularly spaced ballstops. These ballstops are commonly referred to as "canoes." Four of the canoes are radially disposed, and four of the canoes are tangentially disposed with respect to a circle concentric with the main spindle and substantially in the radial center of the lower track.

The gaming term for the person who operates the wheel is tourneur. It is common usage in the art to refer to the tourneur as a dealer. In operation, the dealer imparts a motion to the ball so that the ball travels in the circular track in a clockwise direction. The dealer imparts sufficient force so that the ball will travel at least three rotations before losing momentum and entering the lower track from the circular track due to the force of gravity. At approximately the same time as releasing the ball, the dealer turns the wheel in a counterclockwise direction. As the ball begins its approximately spiral motion toward the wheel, it may or may not hit a canoe. The ball reaches the wheel and lands in a pocket corresponding to a particular number.

Winners and losers and odds of payoffs are determined in accordance with the number. The modern roulette wheel contains 36 integers from 1 through 36. The "American" roulette wheel additionally has a 0 and a 00. The "French" or "European" wheel has 36 numbers and only a single zero. The zeros are typically marked on green backgrounds. The integers are each "red" or "black". In the outward facing numbers, groups of numbers and each color are spaced out in a mathematically balanced fashion. In the American wheel, the numbers 0 and 00 are directly opposite each other in the outward facing number band. The colors alternate around the wheel and odd numbers alternate with even numbers. The sum of each two successive numbers of the same color must equal 37. There are two exceptions, namely the numbers 9 and 28 and the numbers 10 and 27. These pairs are not of the same color.

Inside bets are wagers on the integers and the zeros. These can be "straight-up bets" that cover a single number, and pay 35:1, "split bets" that cover two numbers and pay 17:1, "corner bets" that cover four numbers and pay 8:1, "street bets" that cover three numbers and pay 11:1, "line bets" that cover six numbers and pay 5:1 or "top line bets" that cover five numbers and pay 6:1. Outside wagers are on red-black, odd-even and high-low that can pay even money, or bets on the "columns" or "dozens" (12 numbers each) that pay 2:1.

Despite the fact that the roulette wheel is designed to randomize results, it is well known that an experienced roulette dealer can locate or "hit" a section or group of numbers on the wheel. This is possible since dealers determine the speed of the ball and of the wheel. In the typical course of spending eight hours a day, five days a week for years in a row, dealers develop a great deal of experience and technique. Many dealers become capable of locating a specific section or even perhaps hitting a specific number. This is possible despite the presence of the canoes in the lower track.

European wheels, generally give a house advantage of 2.70%. With American wheels, all bets except the five number bets have a house advantage of 5.26%. A dealer need only be able to hit just one particular side of a wheel to alter the odds. The only safeguard which a casino has to achieve an unbiased result in the movement of the ball is to instruct the dealer not to look into the wheel upon spinning. Disadvantages accrue to the house due to lack of randomness. One disadvantage is the ability of a dealer and a confederate to cheat the house. The other is that experienced players may avoid the house's roulette wheels since they feel that the dealer has the ability to lower their odds.

It is therefore important to provide an apparatus which retains the traditional feel of play of roulette while randomizing results. Various devices have been provided to remove manual aspects of roulette dealing. For example, U.S. Pat. Nos. 4,989,873 and 4,906,005 include blowers for sending a ball through a tube to a propulsion device by which the ball is propelled to an outer track. U.S. Pat. No. 4,337,945 shows an automatic roulette ball spinner which includes a pneumatically powered plunger for propelling a ball. The plunger can have a varied striking force by the utilization of a randomly adjusted throttle for a compressor. These gaming devices do not preserve the traditional roulette game, but provide for mechanical substitutes. It would be highly desirable to provide a roulette apparatus providing for a traditional dealer-operated game while randomizing the results.

SUMMARY OF THE INVENTION

It is therefore a general advantage of the present invention to provide a roulette apparatus for operation by a dealer which allows for randomization of results.

It is a more particular advantage to the present invention to provide randomized airbursts for affecting travel of the ball to provide a technological approach to randomizing ball travel while maintaining traditional roulette table appearance.

Briefly stated, in accordance with the present invention, there is provided a roulette wheel apparatus designed to conform with standard roulette wheel specifications but further including means for randomizing travel of a roulette ball. Air jets coupled to a pneumatic supply provide randomized bursts to affect the motion of a ball. The changes in motion cannot be anticipated by a dealer. The air jets comprise air passages formed in each canoe. An air compressor and a control for providing randomized bursts of air are provided. Air therefrom is coupled via pneumatic distributing means to a central bore in each canoe having an inlet below the roulette table surface. Each central bore supplies the air jets which each extend to facets of each canoe. In the preferred form, three jets are provided. An air jet is not provided in the facet of the canoe that faces the path of travel of the ball.

BRIEF DESCRIPTION OF THE DRAWINGS

The means through which the foregoing special advantages and features of invention are achieved are pointed out with particularity in the claims forming the concluding portion of the specification. The invention, both as to its organization and manner of operation may be understood by reference to which the following description taken in connection with the following drawings.

Of the drawings.

DETAILED DESCRIPTION OF THE PREFERRED EMBODIMENTS

Figure 1:
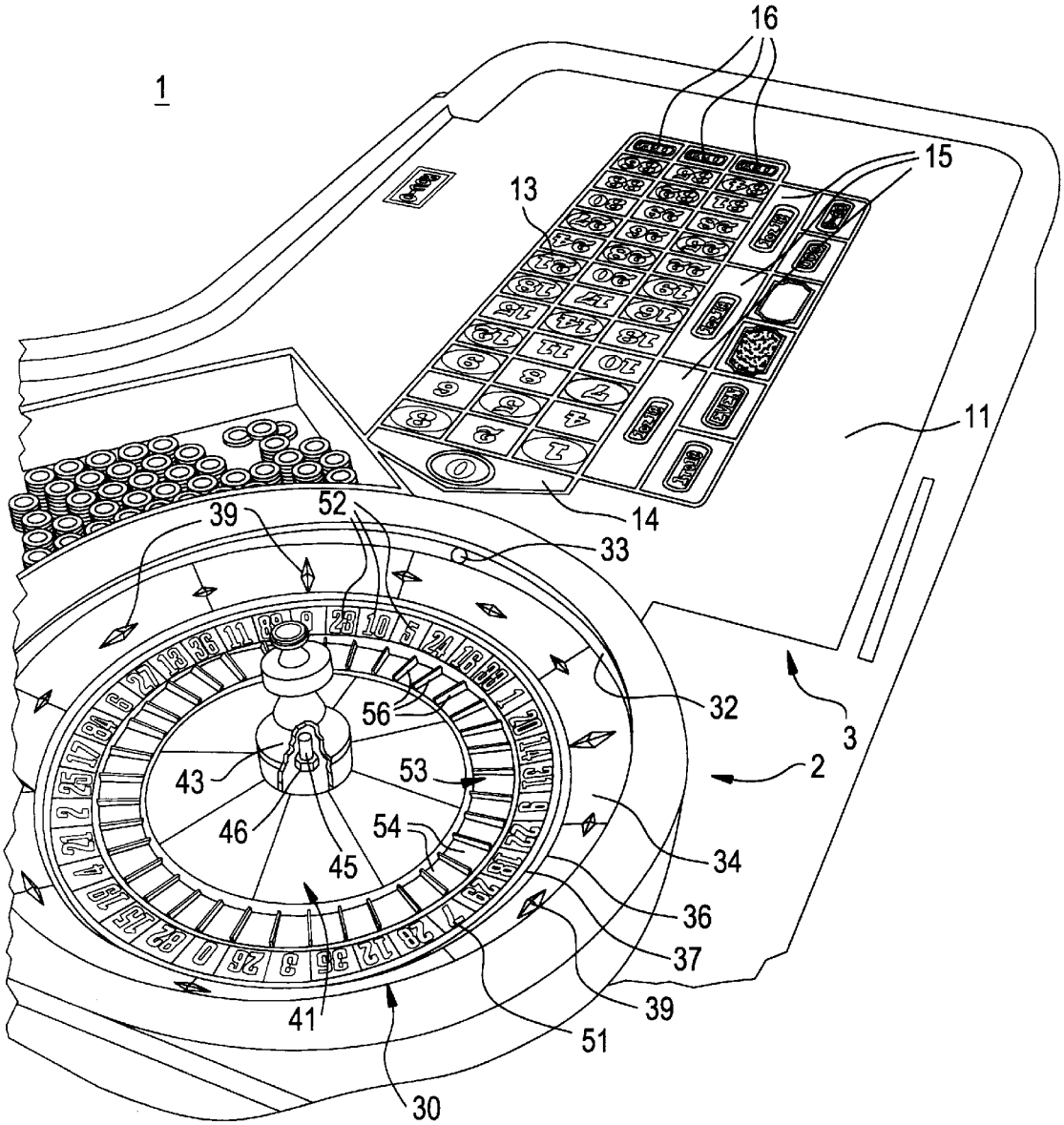
FIG. 1 is a axonometric view of a roulette wheel which may incorporate the present invention.

FIG. 1 is a perspective view of a roulette table 1 including a wheel assembly 2 and a field 3. Customarily, the field 3 is formed on a green felt flat surface 11. The current embodiment is illustrated as a French wheel having a field 3 with number grid 13 labeled with the integers 1–36 and a zero grid 14 containing a single zero. Additionally, outlaying areas 15 and 16 are provided for placing bets on groups of twelve or eighteen numbers.

The wheel assembly comprises a bowl 30 comprising a circular upper track 32 for accommodating a roulette ball 33 shown in motion in the track 32. The track surrounds an annular lower track 34, which meets the upper track 32 at a lower end of its circumference and slopes downwardly toward an inner diameter 36

The inner diameter 36 surrounds a circular recess 37. Aligned on a circle roughly at the radial midpoint of the lower track 34 are located "canoes" 39. Conventionally, there are eight canoes 39 which are "diamond shaped," being nearly rhomboidal parallelograms. The canoes 39 are equally angularly spaced and alternate between a radial orientation and a tangential orientation with respect to the circle on which the centers of the canoes lie. The circular recess 37 receives a wheel 41. A turret 43 projects upwardly from the center of the wheel 41. The turret 43 is shown partially broken away to illustrate a shaft 45 projecting from the bowl 30. The wheel 41 includes a central bearing 46 which receives the shaft 45 and rotates on the shaft 45.

The wheel 41 comprises an outer radial ring 51 including outwardly facing numbers 52, corresponding to the numbers in the field 3. Radially inwardly of the outer ring 51 is a pocket ring 53 comprising one pocket 54 in registration with each outwardly facing number 52. Each pocket 54 is separated from the next pocket 54 by a fret 56. "Fret" is the term in the art for a separator between pockets. In operation, a dealer imparts velocity to the ball 33 such that centrifugal force maintains the ball 33 in the track 32 for at least a preselected number of revolutions about the wheel 41. At the same time, the dealer pushes the one of the frets 56 to spin the wheel 41 in a counterclockwise direction. Once the ball 33 begins to be drawn by gravity toward the wheel 41, the ball continues on an approximately spiral path and eventually reaches the wheel. It may hit one of the canoes 39. It may bounce after hitting the wheel 41 or on of the frets 56 and eventually rests in a pocket 54. The number 52 corresponding to the pocket 54 is the "winner" and payoffs and loses are determined accordingly.

Figure 2:
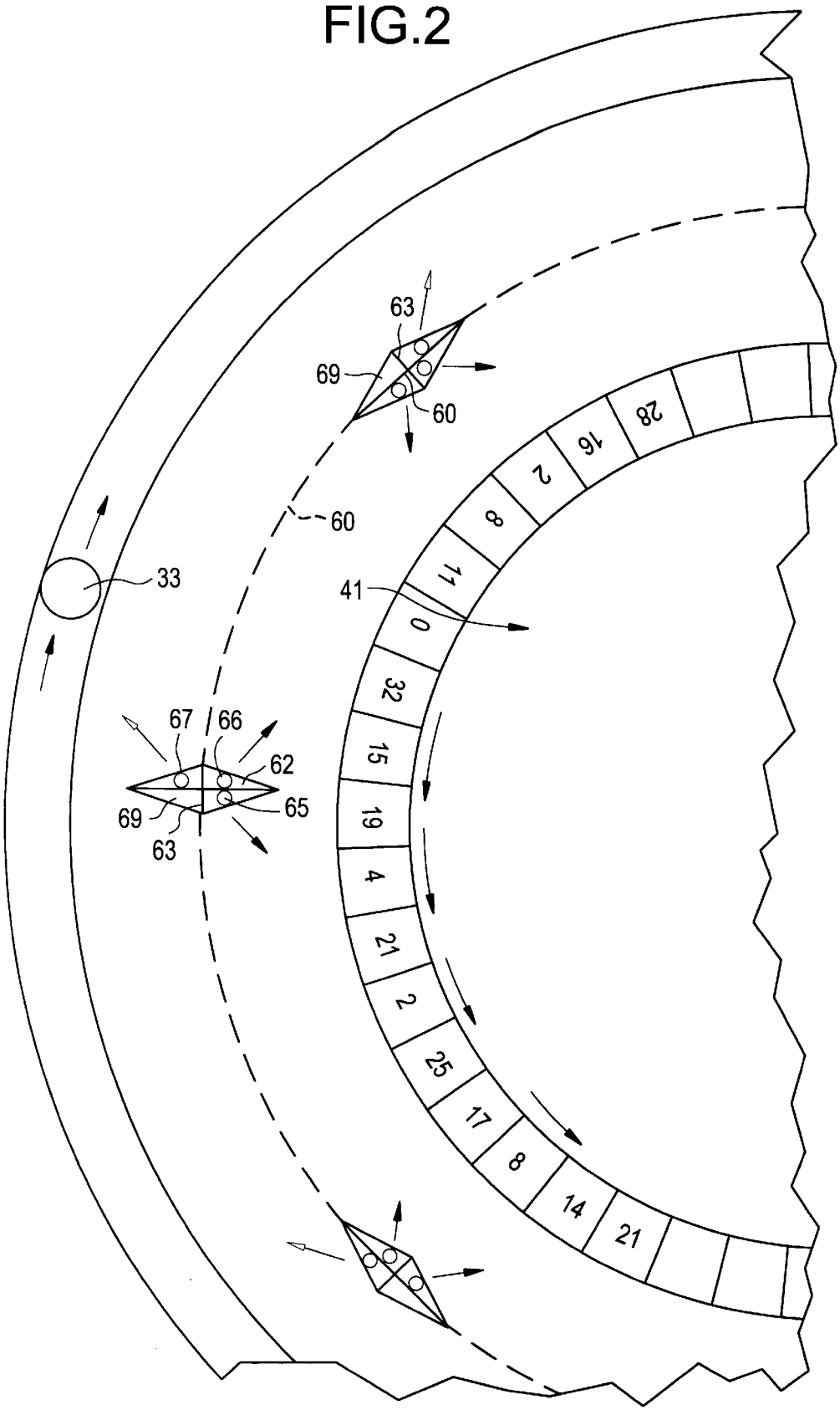
FIG. 2 is a partial detailed view further illustrating positioning of canoes in a lower track.
Figure 3:
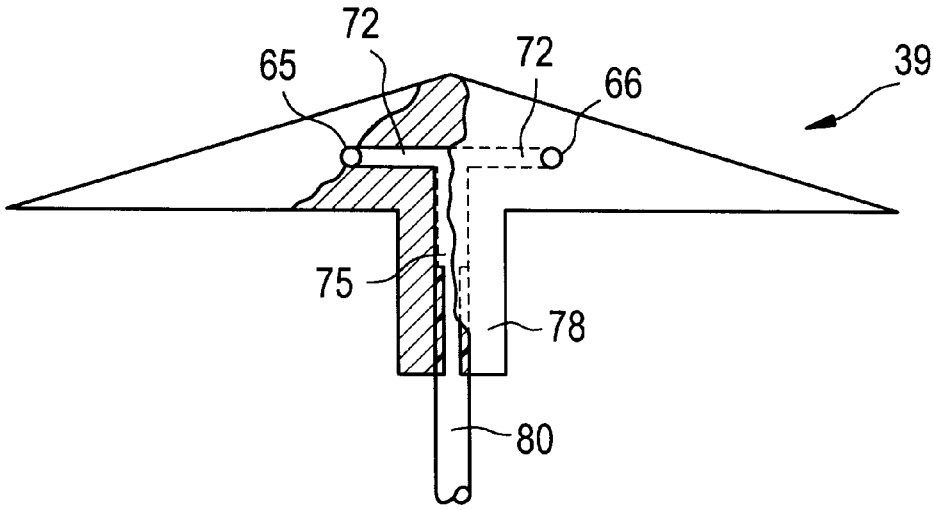
FIGS. 3 and 4 are respectively an elevation, partially broken away, and a plan view of canoes constructed for use with the present invention.
Figure 4:
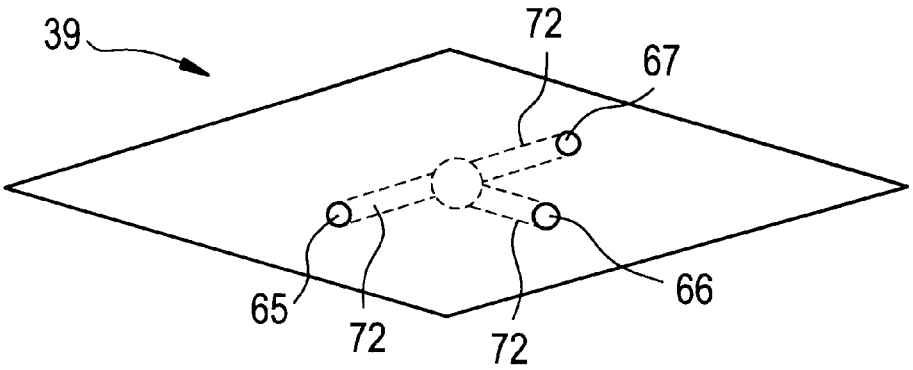

The canoes are further explained with respect to FIGS. 2, 3 and 4 which are respectively a partial detailed view of FIG. 1, and a plan, partially broken away, and an elevation of a canoe 39. In the various drawings, the same reference numerals are used to denote the same components. As seen in FIG. 2, the canoes 39 lie on a circle 60. Alternate canoes 39 have a long axis 62 substantially radial with respect to the circle 60 and the remaining canoes have the long axis 62 substantially tangential to the circle 60. Each canoe 39 has air outlets 65, 66, and 67 in a respective facet 69 of the canoe 39. The facet 69 is not a true facet in that it is not planar. However, the surface of the canoe 39 is described as having facets 69 because the surface of the canoe 39 generally faces in four directions. The directions of the air jets are substantially diagonal with respect to the long axis 62 of each canoe 39. The air outlet 65 faces toward the wheel 41 in the direction of the approach of the ball 33. Air outlets 66 and 67 face the direction of travel of the ball and respectively face the wheel 31 and the upper track 32. In the preferred embodiment, an air outlet is not provided on the facet 69 facing the approach of the ball and the upper track 32. While an air outlet could be provided on this facet 69, the effect on travel of the ball 33 would be greater than that provided by air from the other outlets 65–67. It is preferred in accordance with the invention to minimize the noticeability of effect on the travel of the ball 33 by the airstreams.

In one particular example of the canoe 39, the length of the long axis 62 is 5.2 cm. The air outlets 65, 66 and 67 have their centers approximately 0.3 cm above the surface of the lower track 34. They are also approximately 0.6 cm from the short axis 63 of the canoe 39.

FIGS. 3 and 4 illustrate one of the tangentially disposed canoes 39. Air jets 72 comprise bores from each of the air outlets 65, 66 and 67 to a central portion thereof. The air jets 72 communicate with a central bore 75 that connects the air jets 72 to the exterior of the canoe 39. The central bore 75 is concentric in a central shaft portion 78 of the canoe 39. The shaft portion 78 projects through the lower track 34 to a lower side of the bowl 30. The central bore 75 received an air tube 80 which receives air supplied from the air supply subassembly illustrated with respect to FIG. 5.

Figure 5:
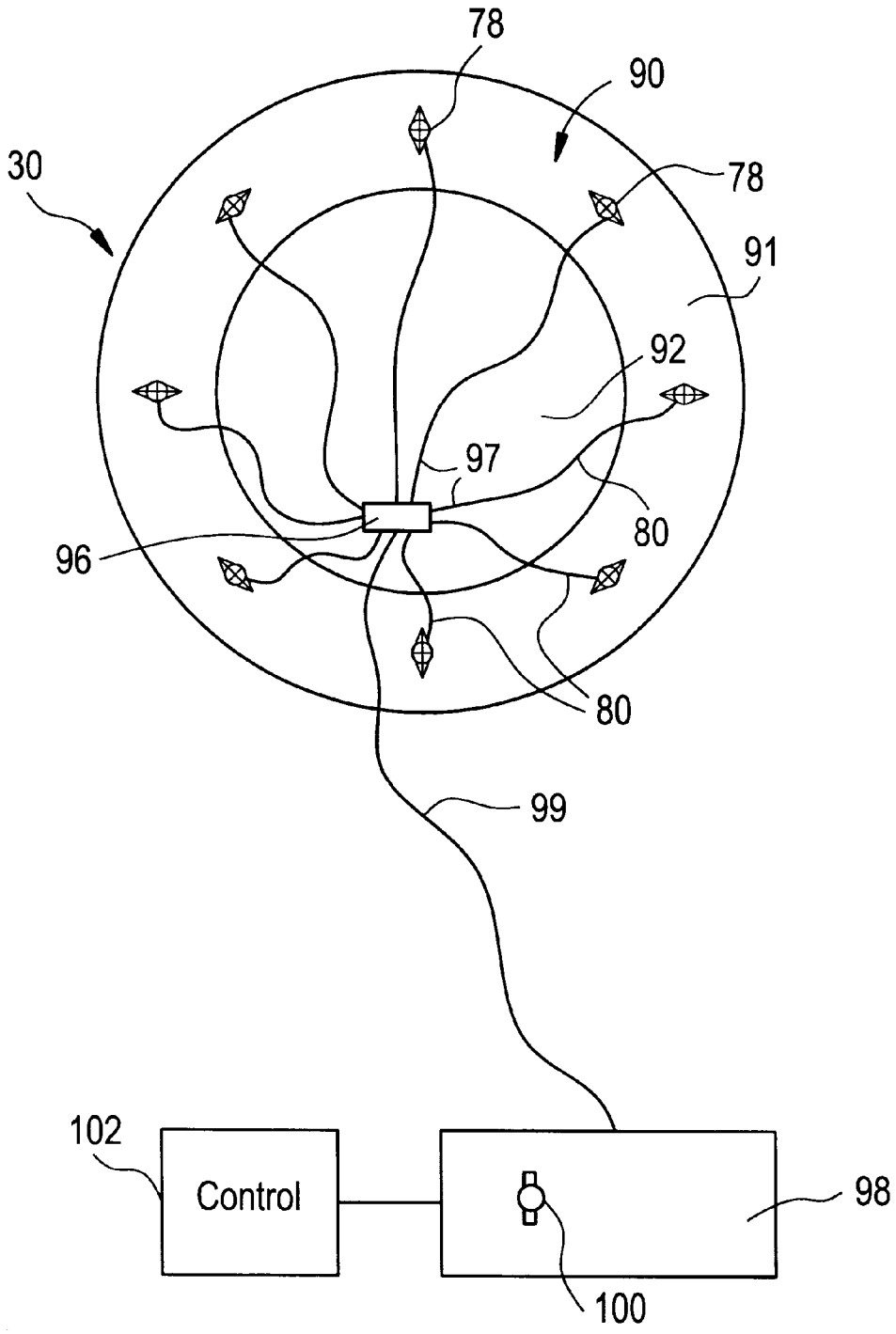
FIG. 5 is an electrical and mechanical schematic diagram of a compressor and of hydraulic circuitry connected below the bowl of a roulette wheel in accordance with the present invention.

FIG. 5 is a mechanical and electrical diagram demonstrating means for supplying air to the canoes 39. The bowl 30 has a lower surface 90 as seen in FIG. 5. A portion 91 of the lower surface 90 is in registration with the lower track 34. Reference numeral 92 represents the lower side of the circular recess 37. Each of the air tubes 80 is connected from a central shaft 78 of a canoe 39 to an air manifold 96. The air manifold 96 may take many different forms. In each form, it will have a pneumatic port 97 to which each air tube 80 is connected. The air manifold 96 may also include pneumatic logic to select air tubes 80 to which air will be connected at selected times. The manifold 96 is supplied through an air supply line 99 by an air supply motor 98 which contains a variable speed air pump driven by a motor 100. The motor 100 is controlled by a control unit 102. The control unit 102 may, for example, comprise a microprocessor providing a random number output and varying the speed of the motor in accordance with random numbers produced thereby. Many different means could be provided for varying the speed of the motor 98. Motor speed control is well-known in the art. There are many ways that are known of varying motor speed in accordance with the teachings of the present invention.

In commercial embodiments, the air supply line 99 and the air input tubes 80 as well as the air supply means 98 are mounted where they will not be readily reachable by anyone intending to tamper with the randomizing apparatus.

Figure 6:
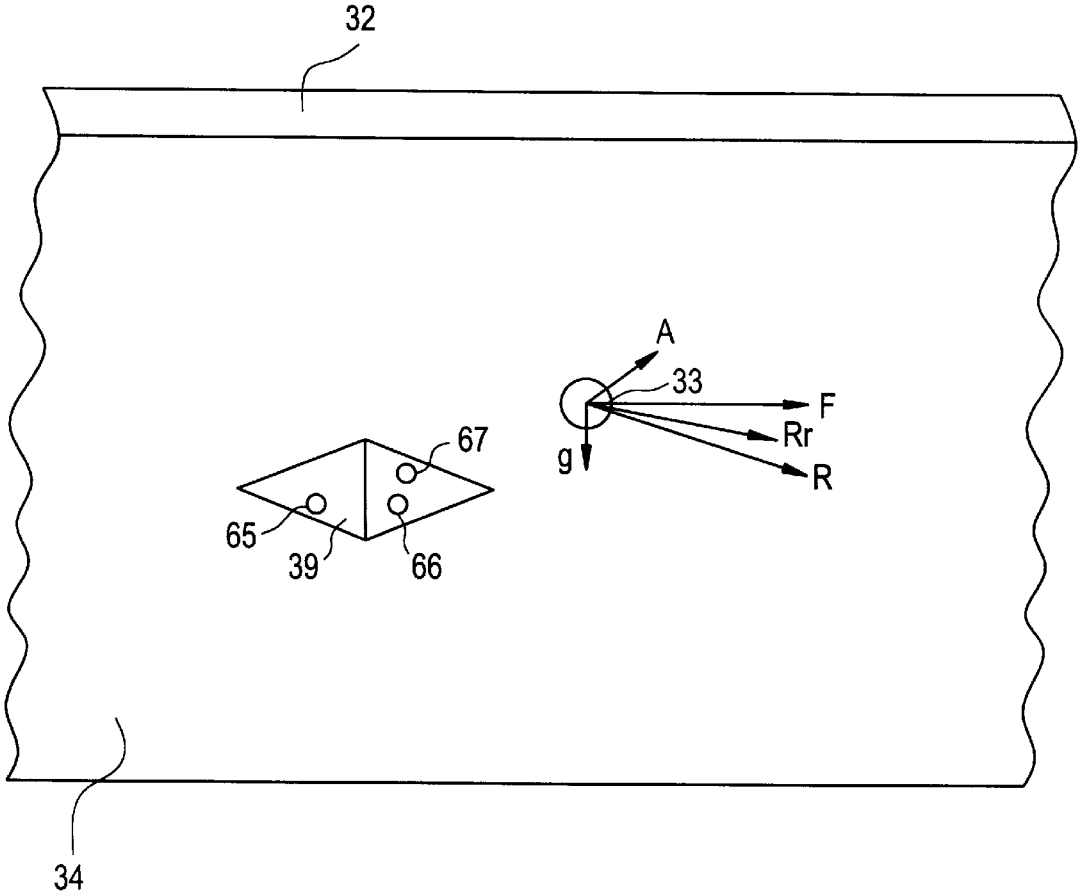
FIG. 6 is a vector diagram showing interaction of air jets on a wall with a ball in accordance with the present invention.

Referring now to FIG. 6, there is illustrated a vector diagram in which one sample scenario is illustrated of how air coming from an air outlet 65, 66, or 67 affects travel of a ball 33. In the absence of air supplied from the canoes 39 to the ball 33, forces acting on the ball 33 will comprise force F due to the motion imparted by the dealer to the ball 33 less friction encountered on the track 34. Also, the force g of the gravity pulls the ball 33 down. A resultant vector of the forces applied to the ball 33. In this particular example, air applies a force A to a ball 33 passing an air outlet 67. Since the air outlet 67 is on a slope and facing upwardly toward the upper track 32, a vertical component is applied to the ball. Consequently, a randomized resultant Rr is provided. The size of the force applied to the ball depends on the current state of the control circuit 102 driving the motor 100. The force to be applied by the ball in the vicinity of a canoe 39 is unpredictable. Consequently, randomization of ball travel for the ball 33 is maintained. The term "vicinity" as used herein means an area in which the ball travel can be affected by the outputs of a canoe 39. The vicinity will be a definite area for each set of physical parameters associated with a given roulette table. These parameters include the weight of the ball 33 and the maximum velocity air that the air supply apparatus 96 is arranged to provide.

What is thus provided is a reliable means for randomizing the travel of a roulette ball in its travel from an upper track to a lower track and a wheel. The specification will enable those skilled in the art to construct many different forms of randomized roulette wheel in accordance with the present invention.

We claim:

1. A roulette wheel assembly comprising an upper track for receiving a ball directed to the track with velocity imparted thereto, a lower track traversed by said ball in route to a wheel, said lower track comprising a plurality of canoes placed along said lower track said canoes for affecting travel of the ball when hit by said ball, and air jets formed in at least one of said canoes for providing air flow to affect travel of the ball when the ball comes within a vicinity of said canoe.

2. The roulette wheel assembly of claim 1 wherein said air jets are formed in a plurality of said canoes.

3. The roulette wheel assembly according to claim 2 wherein said air jets are formed by a pneumatic means and wherein said pneumatic means comprises a central bore in a central portion of each said canoe and an air jet communicating with each said central bore for directing air from said respective canoe toward positions on said lower track which the ball may traverse in the course of its travel to the wheel.

4. The roulette wheel assembly of claim 1 wherein said canoes have a quadrilateral outline and wherein said airjets are formed in selected sides of said canoe.

5. The roulette wheel assembly of claim 1 wherein said at least one canoe comprises three air jets, and the face of said canoe facing toward the upper track and the direction of travel of said ball not including an air jet.

6. The roulette wheel assembly of claim 1 further comprising air supply means coupled to said air jets, said air supply means comprising means for varying air supply to said canoes.

7. The roulette wheel assembly of claim 6 where said means for varying air supply comprises means for randomizing the air supply.

8. The roulette wheel assembly of claim 6 wherein said air supply means comprises an air pump, a manifold connected to said air pump and means pneumatically coupling each canoe to said manifold.

9. In a roulette wheel assembly including a bowl in which a central number wheel is mounted for revolution and an upper track into which a dealer propels a ball and a lower track traversed by the ball in route from the upper track to the central number wheel, said lower track further comprising canoes for deflecting balls coming into contact therewith, the improvement comprising: air jets formed in one or more of said canoes for receiving air flow from a controlled source.

10. The improvement of claim 9 further comprising an air source, said air source further comprising an air supply and means for randomizing duration of air bursts supplied to said canoes.

11. The improvement of claim 10 wherein said air jets comprise bores in said canoes substantially parallel to said lower track.

12. The improvement of claim 11 wherein said air jets communicate with a central bore communicating with an outside of said canoe.

13. A canoe for incorporation in a randomized roulette wheel comprising facets for providing a reaction to affect travel of a roulette ball upon collision of a roulette ball therewith, said facets being incorporated in an upper surface of said canoe, a central shaft portion projecting from a lower surface of said canoe for extending through a lower track thereof to a lower side of said roulette table, said canoe having a central bore formed through said central shaft thereof, said central bore having an open end communicating below said surface of said roulette wheel, air jets formed in selected facets of said canoe, said air jets each comprising a bore communicating between a facet of said canoe and said central bore, said opening of said central bore comprising means for coupling said air jets to a source of air.

14. The canoe according to claim 13 wherein said canoe has air jets formed in three out of four said facets, said facet facing the direction of an upper track of said roulette wheel and an approach direction of said roulette ball not including an air jet.

* * * * *